US006153280A

United States Patent [19]

Uffmann

[11] Patent Number: 6,153,280

[45] Date of Patent: Nov. 28, 2000

[54] PERFORATED MAGNETIC CARD

[75] Inventor: Robert O. Uffmann, Washington, Mo.

[73] Assignee: Magnet, LLC, Washington, Mo.

[21] Appl. No.: 09/093,665

[22] Filed: Jun. 8, 1998

[51] Int. Cl.[7] ..... B65D 65/28

[52] U.S. Cl. ..... 428/43; 40/124.04; 40/600; 40/661.01; 40/711; 229/92.8; 283/56; 428/900

[58] Field of Search ..... 428/43, 900; 283/56; 40/124.04, 600, 661.01, 711; 229/92.8

[56] References Cited

U.S. PATENT DOCUMENTS

| | | | |
|---|---|---|---|
| 1,264,795 | 4/1918 | Hill | 229/92.8 |
| 2,805,816 | 9/1957 | Morgan | 229/92.8 |
| 3,839,130 | 10/1974 | Dean | 40/124.04 |
| 4,887,763 | 12/1989 | Sano | 229/71 |
| 4,957,311 | 9/1990 | Geisenheimer | 283/56 |
| 5,036,310 | 7/1991 | Russell | 340/569 |
| 5,085,470 | 2/1992 | Peach et al. | 283/58 |
| B1 5,458,282 | 10/1995 | Martin | 229/92.8 |

*Primary Examiner*—Nasser Ahmad
*Attorney, Agent, or Firm*—Howell & Haferkamp, L.C.

[57] ABSTRACT

A magnetic card having a flexible magnetic sheet material bonded to a flexible card blank, the combined blank and magnetic sheet having a magnet panel defined by lines of weakness that allow a user to easily separate and remove the magnet panel from the rest of the magnetic card.

9 Claims, 2 Drawing Sheets

PERFORATED MAGNETIC CARD

BACKGROUND OF THE INVENTION

This invention relates to the construction of informational cards, and specifically to the construction of informational cards having a magnetic feature that allows the cards to be mounted and displayed on conveniently located magnetic receptive surfaces.

Advertisers are always seeking innovative ways to distinguish themselves from other providers of competing goods and services. One way for a vendor to distinguish itself and its products or services is to distribute magnetic information cards which its consumers may place in a convenient and conspicuous location, such as, for example, a refrigerator, where the information is readily accessible and unlikely to be lost. From business cards and advertising cards to novel postcards and greeting cards, magnet cards are growing in popularity. The current construction of magnetic cards, however, has several disadvantages.

A conventional magnetic card typically comprises a flexible card blank to which a flexible magnetic sheet material is attached. The combination of the card blank and magnetic material forms a magnet panel with a magnetic face and a card face that may contain text and graphics. The magnet panel is separable from the blank via perforations. The card blank may be printed with text and graphics in any manner desired, with a special message or graphic on the card face of the magnet panel. When mounted on a magnetic receptive surface, the information contained on the card face of the magnet panel is conveniently displayed.

Reference is made to FIGS. 1 and 2 which show a large sheet 20 of card stock from which a plurality of conventional magnetic cards are made in a conventional manner. Typically, a strip of magnetic material 22 is attached to the large sheet 20 of card stock near the middle of the sheet. The individual magnetic cards 10, shown in dashed lines, are then cut from the combined sheet of card blank 20 and magnetic strip 22. In order to maintain a uniform appearance of the pre-printed offset text and graphics on the magnetic cards 10, some offset or gap between adjacent card constructions is necessary when cutting them out from the combined magnetic strip 22 and card blank sheet 20. Because the magnetic strip 22 is placed in the middle of the card blank sheet 20, both vertical and horizontal offsets 26 result in the magnet sheet material 32 when the magnetic cards 10 are cut out. Consequently, an undesirable amount of the magnetic material 26 is wasted in the prior art construction, which causes the cost of production of the magnet cards to be higher than desirable.

Moreover, the prior art construction of magnet cards typically requires three different cuts (the cards on the end of the sheet will require two cuts) through the magnetic sheet material 22 adhered to the blank card sheet 20 to form the magnet panel 12. Also, cutting through the combined magnetic sheet material 22 and card blank 20 several times increases the complexity of the manufacture of the card and contributes to an increased production cost of the cards.

Therefore, construction of the prior art magnetic cards leads to in efficient manufacturing operations and use of materials, as well as compromises the life span of the magnetic card.

SUMMARY OF THE INVENTION

Among the several advantages of the present invention may be noted the provision of a magnetic card that can be made in a cost-effective manner; the provision of a method of making a magnetic card in a manner to reduce the amount of magnetic sheet material that is wasted during manufacture; and the provision of a method of producing magnetic cards to achieve the foregoing advantages.

Generally, the magnetic card of the present invention comprises a blank of flexible material having first and second opposite faces. The first face has a first portion and a second portion. A flexible layer of magnetic sheet material is bonded to the first portion of the first face of the blank. The second portion of the first face of the blank is devoid of a layer of magnetic sheet material. A region of the blank and a region of the magnetic sheet material comprise a magnet panel, with the region of the blank being in a face-to-face relationship with the region of the magnetic sheet material. A line of weakness circumscribes the magnet panel to enable a user to separate the magnet panel from the rest of the magnetic card. The region of the magnetic sheet material is capable of magnetically holding the magnet panel to a magnetic receptive substance.

In another aspect of the present invention, a magnetic card construction comprises a blank of flexible material having first and second opposite faces, first and second opposite side edges, and first and second opposite end edges. A flexible layer of magnetic sheet material is bonded to the first face of the blank with the layer of magnetic sheet material extending generally from the first side edge to the second side edge and spaced from the first and second end edges. A magnet panel comprises a region of the blank and a region of the magnetic sheet material. A first and second spaced lines of weakness extend generally from the first side edge to the second side edge of the blank and define the periphery of the magnet panel. The lines of weakness enable a user to separate the magnet panel from the rest of the magnet card. The region of the magnetic sheet material is capable of magnetically holding the magnet panel to a magnetic substance.

In yet another aspect of the invention, a method of constructing a plurality of magnetic cards is provided so that each card having a blank of flexible material and a flexible layer of magnetic sheet material bonded to the blank. The method comprises the steps of providing a sheet of card blank having opposite edges, attaching at least two strips of a flexible magnetic sheet material to the sheet of card blank so that the magnetic strips are generally parallel to each other and spaced from each other, and cutting the magnetic cards from the sheet of card blank after the magnetic strips have been attached to the sheet of card blank.

Other objects will be in part apparent and in part pointed out hereinafter.

BRIEF DESCRIPTION OF THE DRAWINGS

Corresponding reference characters indicate corresponding parts throughout the several views of the drawings.

DESCRIPTION OF THE PREFERRED EMBODIMENT

Figure 1:
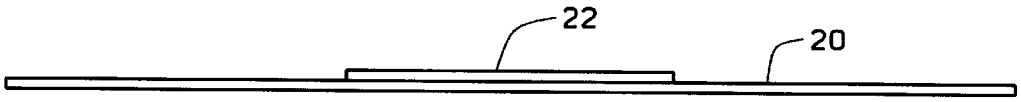
FIG. 1 PRIOR ART
FIG. 1 is a cross sectional view of the manufacture of a plurality of the prior art magnetic cards.
Figure 2:
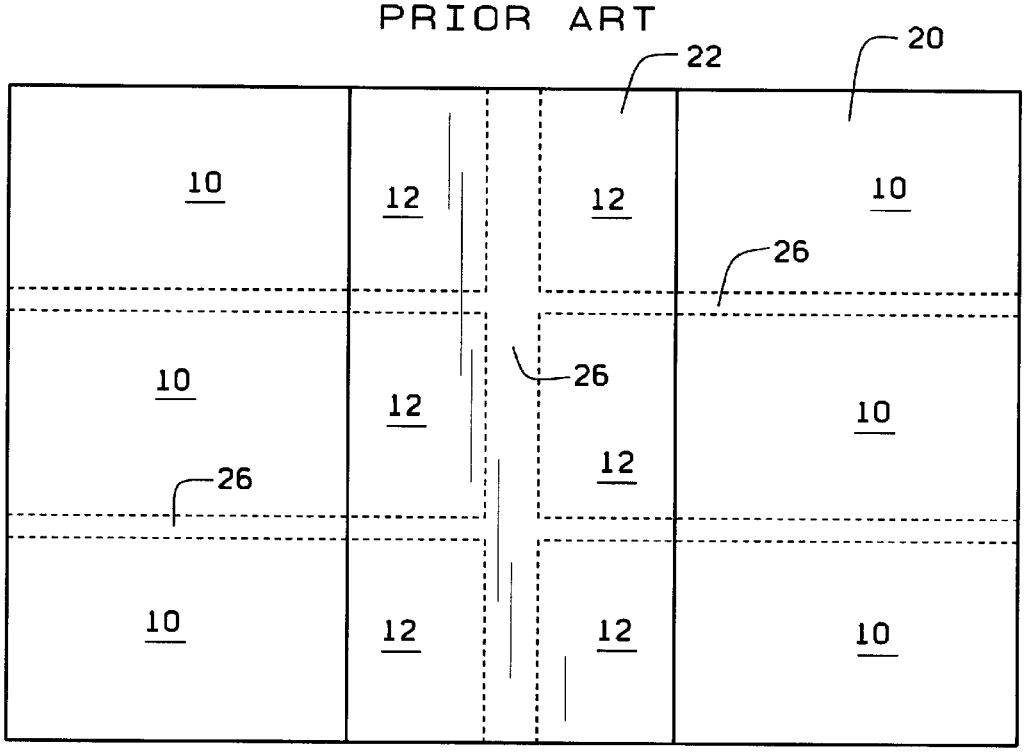
FIG. 2 PRIOR ART
FIG. 2 is a top view of a prior art device having a magnet strip secured to the middle of a sheet of card stock.
Figure 3:
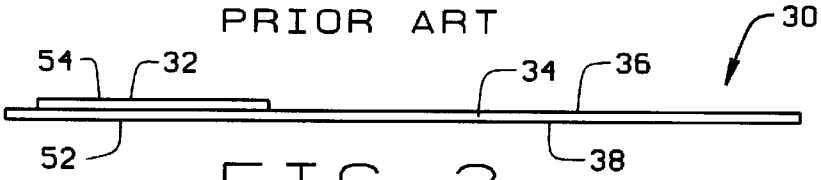
FIG. 3 is a side elevational view of a magnetic card of the present invention.

Referring now to FIGS. 3 through 7, a magnetic card of the present invention is indicated generally by the reference numeral 30. A flexible layer of magnetic sheet material 32 is bonded to a blank 34 of flexible material. The blank has opposite first and second faces 36, 38 as well as opposite first and second side edges 40, 42 and opposite first and second end edges 44, 46. While the magnetic card is shown as generally rectangular in shape, a rectangular shape is by no means necessary to achieve the advantages of this invention. The rectangular shape shown and described herein is for illustrative purposes only. Other shapes my be used as desired without departing from the scope of this invention.

The first face 36 of the blank 34 has a first portion 48 and a second portion 50. The flexible layer of magnetic material 32 is bonded to the first portion 48 of the first face 36 of the blank 34. The magnetic layer 32 may be bonded to the blank 34 by various methods, both manual and automated, that are well known in the art. The magnetic layer 32 is spaced from the opposite end edges 44, 46 and extends from end-to-end of the opposite side edges 40 and 42. The second portion 50 of the first face 36 of the blank 34 is devoid of the layer of magnetic material. Preferably, the blank 34 is pre-printed with text and graphics to convey a particular message to the recipient of the card.

A region of the blank 52 and a region 54 of the magnetic sheet material form a magnet panel 56. The first face 36 of the region 52 of the blank is bonded to a face of the region 54 of the magnetic material 54. The regions 52, 54 are coextensive when bonded together and are defined by lines of weakness 58.

Preferably, the lines of weakness 58 are either perforations or kiss cuts. Perforations extend through the blank region 52 and the magnetic sheet region 54 and are well suited for situations in which the magnetic card. 30 will be subject to much handling during distribution, such as through the mail. On the other hand, a kiss cut is more aesthetically appealing but is less structurally sound than a perforation. Except for the higher risk of premature separation during distribution of the magnetic cards when using a kiss cut, these two types of lines of weakness serve the invention equally well.

The lines of weakness 58 enable a user to separate the magnet panel 56 from the rest of the magnetic card 30. The lines of weakness 58 enable the magnet panel 56 to be easily and smoothly torn away from the magnetic card 30 by the user. Apart from the lines of weakness, the blank 36 and the magnetic sheet 32 are relatively difficult to tear smoothly. Once the magnet panel 56 is removed from the magnetic card 30, the magnet panel may be mounted on a convenient magnetic receptive surface by placing the magnetic region 54 of the magnet panel against the magnetic surface, such as a refrigerator or a metal file cabinet. The text and graphics on the blank region 52 of the magnet panel 56 may then be magnetically held to the magnetically receptive surface and prominently displayed with little chance of having the information lost or misplaced.

Figure 4:
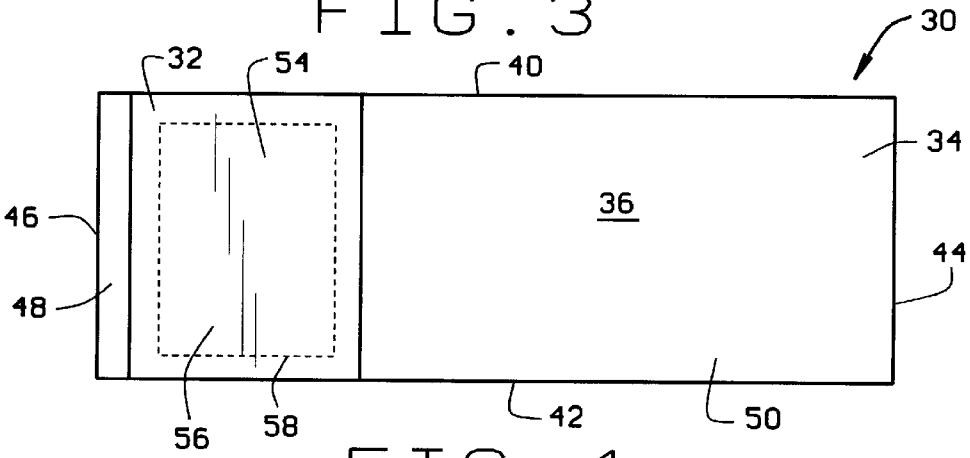
FIG. 4 is a top plan view of the magnetic card of FIG. 2.
Figure 5:
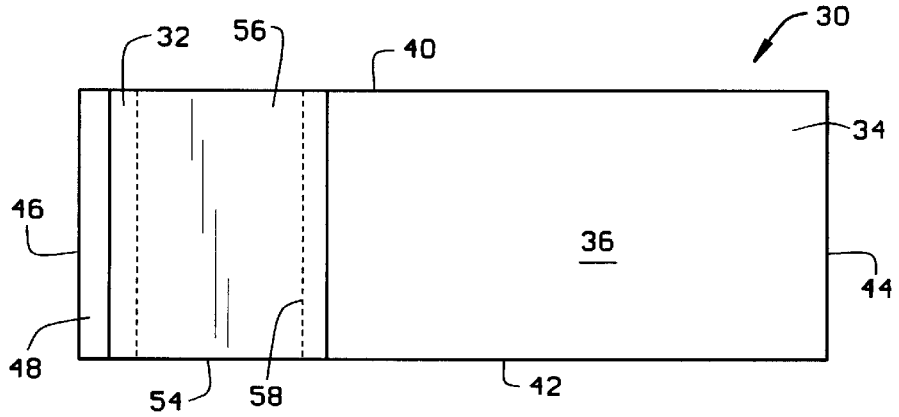
FIG. 5 is a top plan view of another magnetic card of the present invention.

The lines of weakness 58 may completely circumscribe and define the periphery of the magnet panel 56, as shown in FIG. 4. Alternatively, they may extend from a first side edge 40 of the magnetic card 30 to the second side edge 42 of the magnetic card, as shown in FIG. 5. In this configuration, the lines of weakness and the side edges 40, 42 of the magnetic card define the periphery of the magnet panel 56. For illustrative purposes, the lines of weakness 58 are shown as straight lines that define generally rectangular magnet panels 56, but the lines of weakness may alternatively define a contour of any shape desired for the magnet panel.

Figure 6:
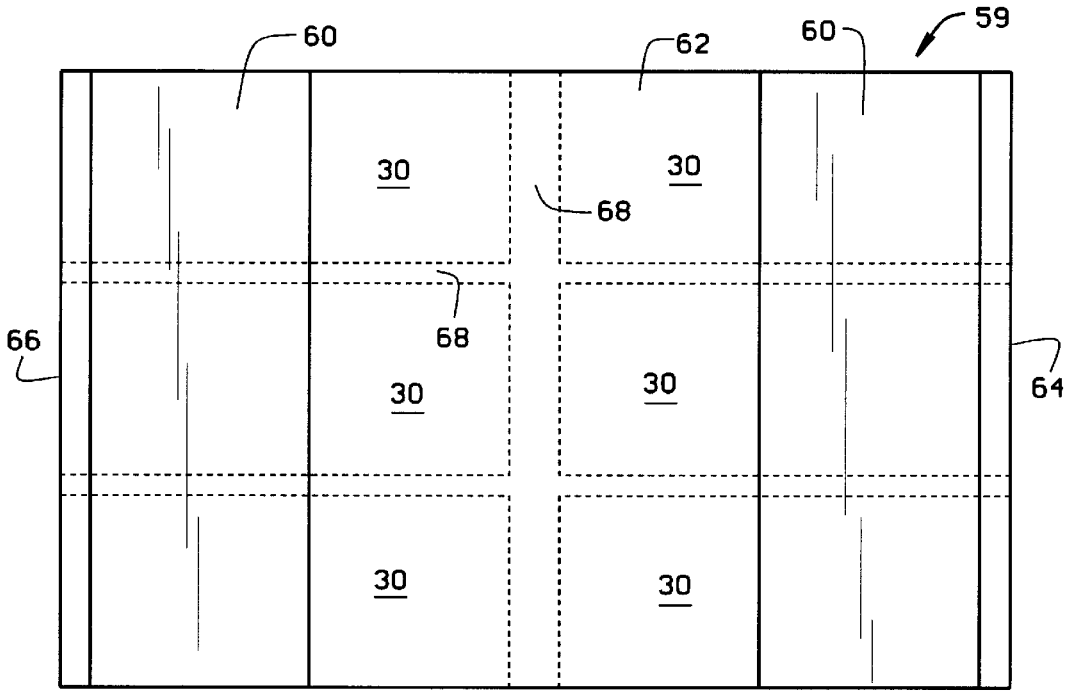
FIG. 6 is a top view of a dual magnetic strip card sheet of the present invention.
Figure 7:
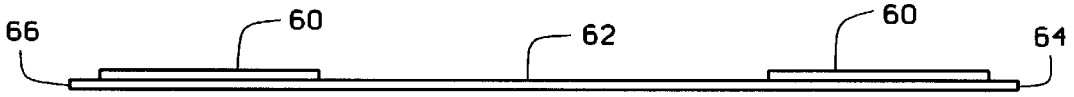
FIG. 7 is a side elevational view of the dual magnetic strip card sheet of the present invention.

The dual magnetic strip card sheet of the magnetic cards of the present invention is shown in FIGS. 6 and 7. Two magnetic strips 60 are bonded to a sheet of card blank 62 dimensioned to contain a plurality of magnetic cards 30, shown in dashed lines in FIG. 6. The magnetic strips are bonded to the blank card sheet in a manner well known, whether manually or automated, in the prior art.

The magnetic strips 62 are bonded to the blank sheet 62 in a generally parallel fashion. The magnetic strips are mounted spaced apart from each other, and are approximately equally spaced from the side edges 64, 66 of the blank sheet 62. The individual magnetic cards 30, shown in phantom in FIG. 6, may then be cut from the large blank sheet 62 after the magnetic strips 60 are sufficiently bonded. The magnetic cards may be cut by any means in the art.

The blank sheet 62 is preferably pre-printed with text and graphics, and, to maintain a uniform appearance of the magnetic cards when they are finished, preferably contains a small offset 68 of space between the graphic images and text. By no means, however, is such an offset required for the benefits of the present invention to be appreciated.

It is therefore evident from FIG. 6 that no more than two cuts through the magnetic strips 62 are required for each card when cutting the cards from the dual magnetic strip card sheet, indicated generally by reference character 59, as opposed to at least two or three cuts required in the prior art construction.

Significantly, less magnetic material is wasted in the construction of the present invention because only one offset 68 of blank space occurs in the regions of the magnetic sheet material 60, versus two offsets in the prior art. Finally, the present invention is less vulnerable to peeling or separating of the magnetic sheet material 32 from the magnetic card 30 during distribution of the cards than the prior art card because only the two side edges 40, 42 of the magnetic material 32 are exposed, while in the prior art three edges of the magnetic material are exposed. Thus, the magnetic cards of the present invention will enjoy a longer life span than their prior art predecessors.

The lines of weakness 58 may be added to the individual magnetic cards 30 either before or after the cards are cut out from the dual magnetic strip card sheet 59. Either perforations or kiss cuts may be used, and either may be employed by means well established in the art. Of course, the combination 59 of the construction may be expanded to include as many magnetic strips 60 as the blank sheet 62 and the dimensions of the magnetic cards 30 may accommodate.

While the present invention has been described by reference to a specific embodiment, it should be understood that modifications and variations of the invention may be constructed without departing from the scope of the invention defined in the following claims.

What is claimed is:

1. A magnetic card comprising:

a blank of flexible material having first and second opposite faces, the first face having a first portion and a second portion;

a flexible layer of magnetic sheet material bonded to the first portion of the first face of the blank, the second portion of the first face of the blank being devoid of the layer of magnetic sheet material;

a magnet panel comprising a region of the blank and a region of the magnetic sheet material, the region of the blank being in a face-to-face relationship with the region of the magnetic sheet material; and a line of weakness circumscribing the magnet panel, the line of weakness weakening the blank all around the magnet panel and weakening the layer of magnetic sheet material all around the magnet panel in a manner for enabling a user to separate the magnet panel from the rest of the magnetic card, the region of the magnetic sheet material being capable of magnetically holding the magnet panel to a magnetic receptive substance.

2. A magnetic card as set forth in claim 1 wherein the line of weakness comprises a line of perforations extending through the blank and through the layer of magnetic sheet material all around the magnetic card.

3. A magnetic card as set forth in claim 1 wherein the blank further includes first and second opposite end edges, the layer of magnetic sheet material being spaced from the first and second end edges.

4. A magnetic card as set forth in claim 3 wherein the blank further includes first and second opposite side edges, the layer of magnetic sheet material extending generally from the first side edge to the second side edge.

5. A magnetic card as set forth in claim 4 wherein the first side edge extends generally from the first end edge to the second end edge and wherein the second side edge extends generally from the first end edge to the second end edge.

6. A magnetic card as set forth in claim 1 wherein the line of weakness comprises a kiss cut.

7. A magnetic card construction comprising:

a blank of flexible material having first and second opposite faces, first and second opposite side edges, and first and second opposite end edges;

a flexible layer of magnetic sheet material bonded to the first face of the blank, the layer of magnetic sheet material extending generally from the first side edge to the second side edge and being spaced from the first and second end edges;

a magnet panel comprising a region of the blank and a region of the magnetic sheet material, the region of the blank being in a face-to-face relationship with the region of the magnetic sheet material so that the region of the blank and the region of the magnetic sheet material are coextensive; and first and second spaced lines of weakness each extending generally from the first side edge to the second side edge, the lines of weakness and the side edges of the blank defining the periphery of the magnet panel, the first and second lines of weakness each weakening the blank and weakening the layer of magnetic sheet material generally from the first side edge to the second side edge in a manner for enabling a user to separate the magnet panel from the rest of the magnetic card, the region of the magnetic sheet material being capable of magnetically holding the magnet panel to a magnetic substance.

8. A magnetic card as set forth in claim 7 wherein the line of weakness comprises a line of perforations extending through the blank and through the layer of magnetic sheet material.

9. A magnetic card as set forth in claim 7 wherein the line of weakness comprises a kiss cut.

* * * * *